US008182065B2

(12) United States Patent
Grosse et al.

(10) Patent No.: US 8,182,065 B2
(45) Date of Patent: May 22, 2012

(54) APPARATUS AND METHODS FOR COMPENSATION OF THERMAL AND HYDROSCOPIC EXPANSION EFFECTS IN A LOW COST MOTION CONTROL SYSTEM

(75) Inventors: Jason Grosse, Vancouver, WA (US); Rick M. Tanaka, Vancouver, WA (US); Steven B. Elgee, Portland, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 1833 days.

(21) Appl. No.: 11/192,623

(22) Filed: Jul. 29, 2005

(65) Prior Publication Data

US 2007/0024659 A1 Feb. 1, 2007

(51) Int. Cl.
*B41J 23/00* (2006.01)

(52) U.S. Cl. ..... 347/37

(58) Field of Classification Search ..... 347/37
See application file for complete search history.

(56) References Cited

U.S. PATENT DOCUMENTS

| | | | | |
|---|---|---|---|---|
| 3,708,681 | A * | 1/1973 | Ivers | 250/231.16 |
| 4,465,373 | A * | 8/1984 | Tamaki et al. | 356/617 |
| 5,945,824 | A * | 8/1999 | Obara et al. | 324/207.22 |
| 6,010,206 | A * | 1/2000 | Simons | 347/40 |
| 6,193,350 | B1 * | 2/2001 | Hadley | 347/37 |
| 6,499,827 | B2 * | 12/2002 | Elgee | 347/37 |
| 7,252,353 | B2 * | 8/2007 | Silverbrook et al. | 347/19 |
| 2003/0016266 | A1 * | 1/2003 | Urselmann | 347/37 |

* cited by examiner

*Primary Examiner* — Shelby Fidler

(57) ABSTRACT

Disclosed are apparatus and methods for compensating for the change in length of an encoder strip due to environmental effects such as temperature and humidity. The apparatus and methods utilize two simple optical sensors spaced apart and mounted on a substrate having a different coefficient of thermal expansion than the encoder strip; the substrate is mounted to the movable component which is to be positioned, such as a printer carriage. Embodiments of the methods utilize information from the two sensors, in conjunction with information from the analog encoder used to position movable component, to compensate for environmental effects.

25 Claims, 7 Drawing Sheets

APPARATUS AND METHODS FOR COMPENSATION OF THERMAL AND HYDROSCOPIC EXPANSION EFFECTS IN A LOW COST MOTION CONTROL SYSTEM

FIELD OF INVENTION

This invention relates generally low-cost motion control systems.

BACKGROUND

Motion control systems are well-known in the art. In many applications, it is necessary to position a movable component with precision and repeatability. One type of motion control system utilizes an encoder strip that is optically scanned by sensors on the movable component.

Inkjet printing systems are also are well-known in the art. Small droplets of liquid ink, propelled by thermal heating, piezoelectric actuators, or some other mechanism, are deposited by a printhead on a print media, such as paper.

In scanning-carriage inkjet printing systems, inkjet printheads are typically mounted on a carriage that is moved back and forth across the print media. As the printheads are moved across the print media, the printheads are activated to deposit or eject ink droplets onto the print media to form text and images. The print media is generally held substantially stationary while the printheads complete a "print swath", typically an inch or less in height; the print media is then advanced between print swaths. The need to complete numerous carriage passes back and forth across a page has meant that inkjet printers have typically been significantly slower than some other forms of printers, such as laser printers, which can essentially produce a page-wide image.

The ink ejection mechanisms of inkjet printheads are typically manufactured in a manner similar to the manufacture of semiconductor integrated circuits. The print swath for a printhead is thus typically limited by the difficulty in producing very large semiconductor chips or "die". Consequently, to produce printheads with wider print swaths, other approaches are used, such as configuring multiple printhead dies in a printhead module, such as a "page wide array". Print swaths spanning an entire page width, or a substantial portion of a page width, can allow inkjet printers to compete with laser printers in print speed.

One type of inkjet printing system utilizes multiple printhead modules that each print a substantial portion of a page width; the modules are on carriages that must be accurately positioned such that visible print defects are not introduced where the separately-printed portions of the page meet. The carriages may also be repositioned during the printing process, such as to allow wider page sizes to be printed using multiple print passes.

Printing is a highly-competitive field, and motion control techniques that may be appropriate in industrial applications are often not cost effective in a printing system. Lower cost materials may also be employed in a printing system; these materials may be more susceptible to environmental effects such as heat and humidity.

There is thus a need for apparatus and methods that allow for the precise and repeatable positioning of movable components at a reasonable cost.

SUMMARY

Exemplary embodiments of the invention include apparatus and methods for compensating for the change in length of an encoder strip due to environmental effects such as temperature and humidity. The apparatus and methods utilize two simple optical sensors spaced apart and mounted on a substrate having a different coefficient of thermal expansion than the encoder strip; the substrate is mounted to the movable component which is to be positioned, such as a printer carriage. Embodiments of the methods utilize information from the two sensors, in conjunction with information from the analog encoder used to position movable component, to compensate for environmental effects.

Other aspects and advantages of the present invention will become apparent from the following detailed description, taken in conjunction with the accompanying drawings, illustrating by way of example the principles of the invention.

DESCRIPTION OF EMBODIMENTS OF THE INVENTION

Embodiments of the invention are described with respect to an exemplary inkjet printing system; however, the invention is not limited to the exemplary system, nor to the field of inkjet printing, but may be utilized as well in other systems.

In the following specification, for purposes of explanation, specific details are set forth in order to provide an understanding of the present invention. It will be apparent to one skilled in the art, however, that the present invention may be practiced without these specific details. Reference in the specification to "one embodiment" or "an exemplary embodiment" means that a particular feature, structure, or characteristic described in connection with the embodiment is included in at least one embodiment. The appearance of the phrase "in one embodiment" in various places in the specification do not necessarily refer to the same embodiment.

Figure 1:
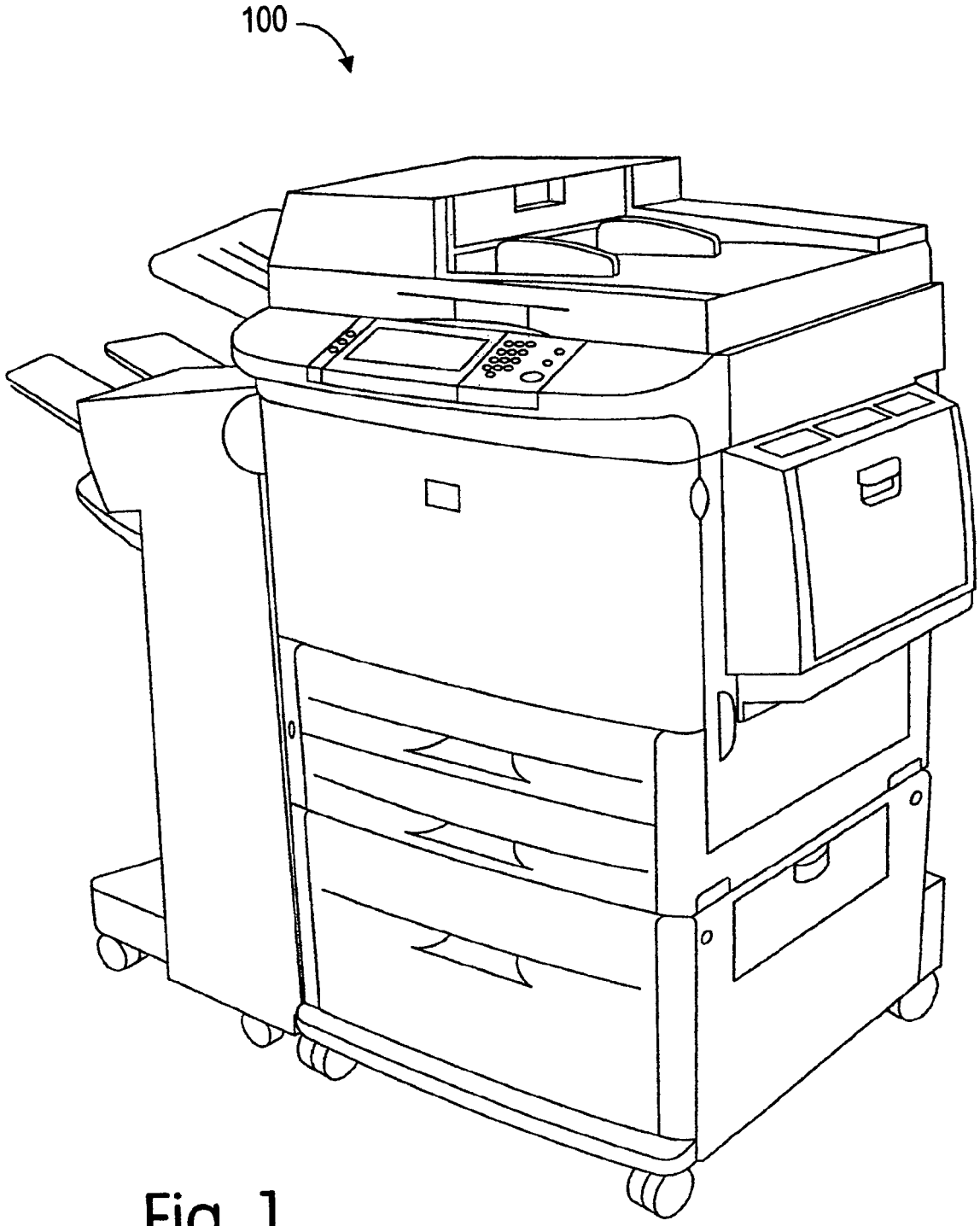
FIG. 1 illustrates an exemplary printing system in which exemplary embodiments of the invention may be utilized.

FIG. 1 illustrates an exemplary inkjet printing system 100 in which embodiments of the invention may be utilized. Intended for moderately high volume printing, the system may also include multiple other functions and may, for example, be connected to an office network to provide printing, scanning, and faxing capabilities to a workgroup.

Figure 2:
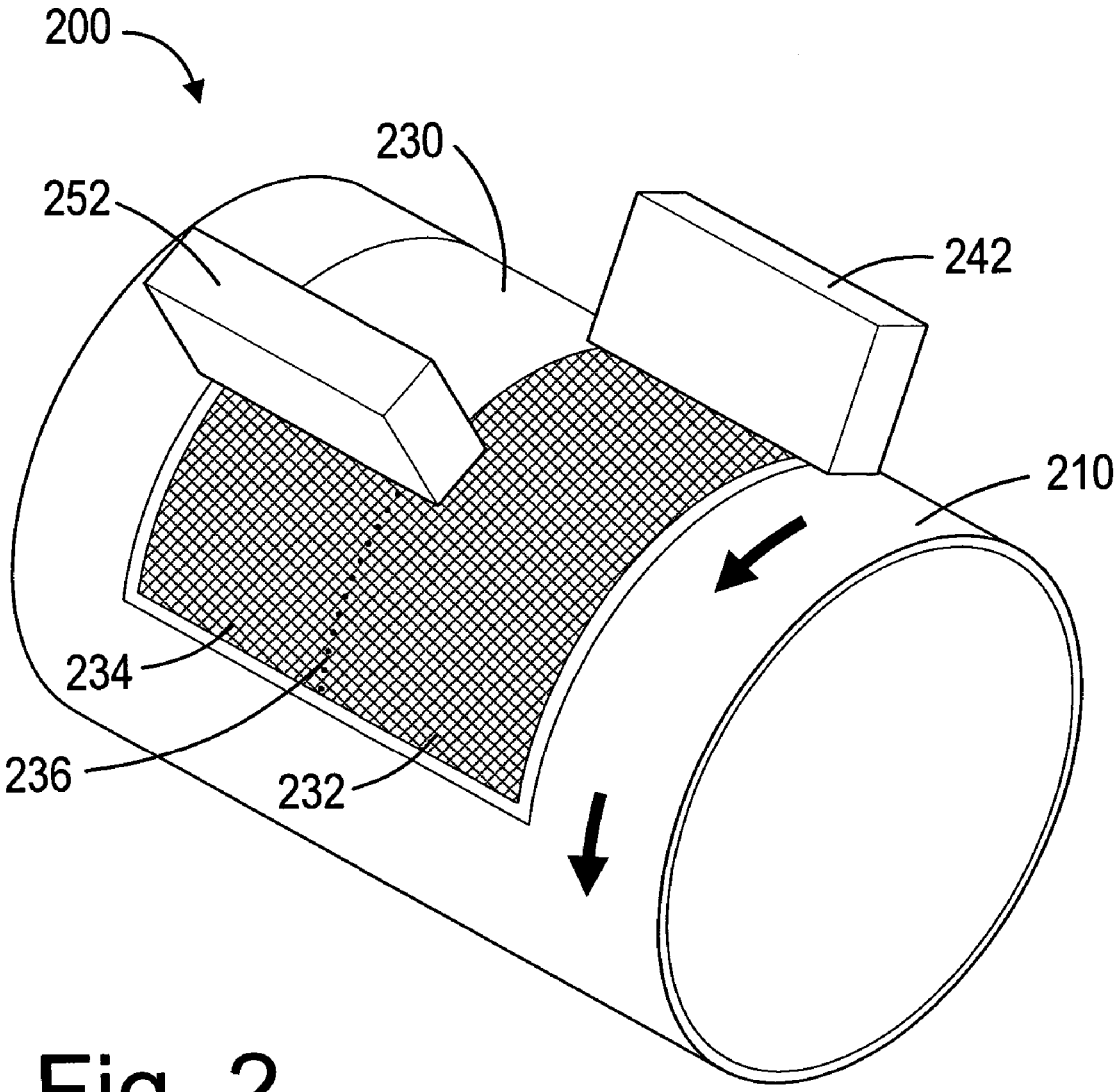
FIG. 2 illustrates the paper path and printhead mechanisms of an exemplary inkjet printing system in which embodiments of the invention may be utilized.

FIG. 2 illustrates the basic media path and printhead mechanisms 200 of an exemplary inkjet printing system in which embodiments of the invention may be utilized. As shown in FIG. 2, print media 230, such as a sheet of paper, is held to a rotating drum 210 by air suction. The print media 230 is rotated past printhead assemblies on print carriages 242, 252 that remain substantially stationary during a printing pass (although the carriages may be repositioned between passes, such as to allow printing of wider media using multiple passes). Multiple carriages with printhead assemblies may be utilized to span the page width as illustrated; one printhead assembly on a first carriage 242 may print a first portion 232 of the page width, and a second printhead assembly on a second carriage 252 may print a second portion 234 of the page width. Where the two portions of the printed page meet is a joint 236, which ideally is not readily perceptible on the completed page. Slight misalignments of the print carriages can, however, cause this joint to be visible as either a light or dark line, or as a visible discontinuity in printed lines crossing the joint.

For multi-pass printing, the print media 230 may be held to the drum 210 by suction for more than one complete revolution of the drum, with printheads on the carriage assemblies 242, 244 depositing ink during each pass of the print media. The printer may include drying mechanisms (not shown) to accelerate the drying of the printed media, which may, for example, be placed near the bottom of the drum 210 such that the printed media may be at least partially dried between printing passes. The carriage assemblies 242, 252 permit the printheads to be moved side-to-side to different locations on the drum or off the drum entirely for servicing, or to reposition the printheads for different paper configurations.

Inkjet printing systems may typically utilize a process known as Automatic Pen Alignment (APA) to initially calibrate the positions of the printheads and carriages. Various APA techniques are described, for example, in U.S. Pat. No. 5,250,956, Haselby et al.; U.S. Pat. No. 5,262,797, Boeller et al.; U.S. Pat. No. 5,289,208, Haselby; U.S. Pat. No. 5,448,269, Beauchamp et al.; U.S. Pat. No. 5,451,990, Sorenson et al.; U.S. Pat. No. 5,600,350, Cobbs et al.; and U.S. Pat. No. 6,234,602, Soto et al. In this process, a pattern is printed on print media which is then detected by optical sensors; the sensed information is utilized to adjust the printing mechanisms or to provide calibration factors to the printer software or firmware. Automatic Pen Alignment typically requires significant time to complete, however, and therefore is not suitable for detecting short-term changes due to environmental factors. Environmental changes subsequent to APA may cause misalignments in a multi-carriage printing system.

Misalignments between print carriages greater then one-half dot row are generally perceived to be unacceptable. Misalignments may be caused, for example, by changes in the length of the encoder strips used to position the print carriages, as discussed below. In one exemplary printing system having two print carriages, temperature changes of 10 degrees centigrade (° C.) subsequent to Automatic Pen Alignment (and without further compensation or correction) have been observed to cause misalignments between the carriages on the order of two dot rows; changes in relative humidity of 30% have been observed to cause misalignments on the order of one dot row. In other terms, the changes due to temperature and humidity easily reach tens of microns during the course of operation of a printer; a 10 micron shift in the absence of any other error is just visible, and shifts greater than 10 microns are unacceptable.

While it would be possible to place temperature and humidity measurement capabilities near the encoder strips and adjust the desired positions to account for the expansions based on the temperature and humidity readings, such an approach is problematic. The sensors typically cost more than can be justified in the highly-competitive field of printing systems; the system would also be dependent on the correct placement of the sensors, and would be unable to compensate for transient behavior such as the time it takes for the encoder strip to reach the ambient temperature or humidity.

Figure 3:
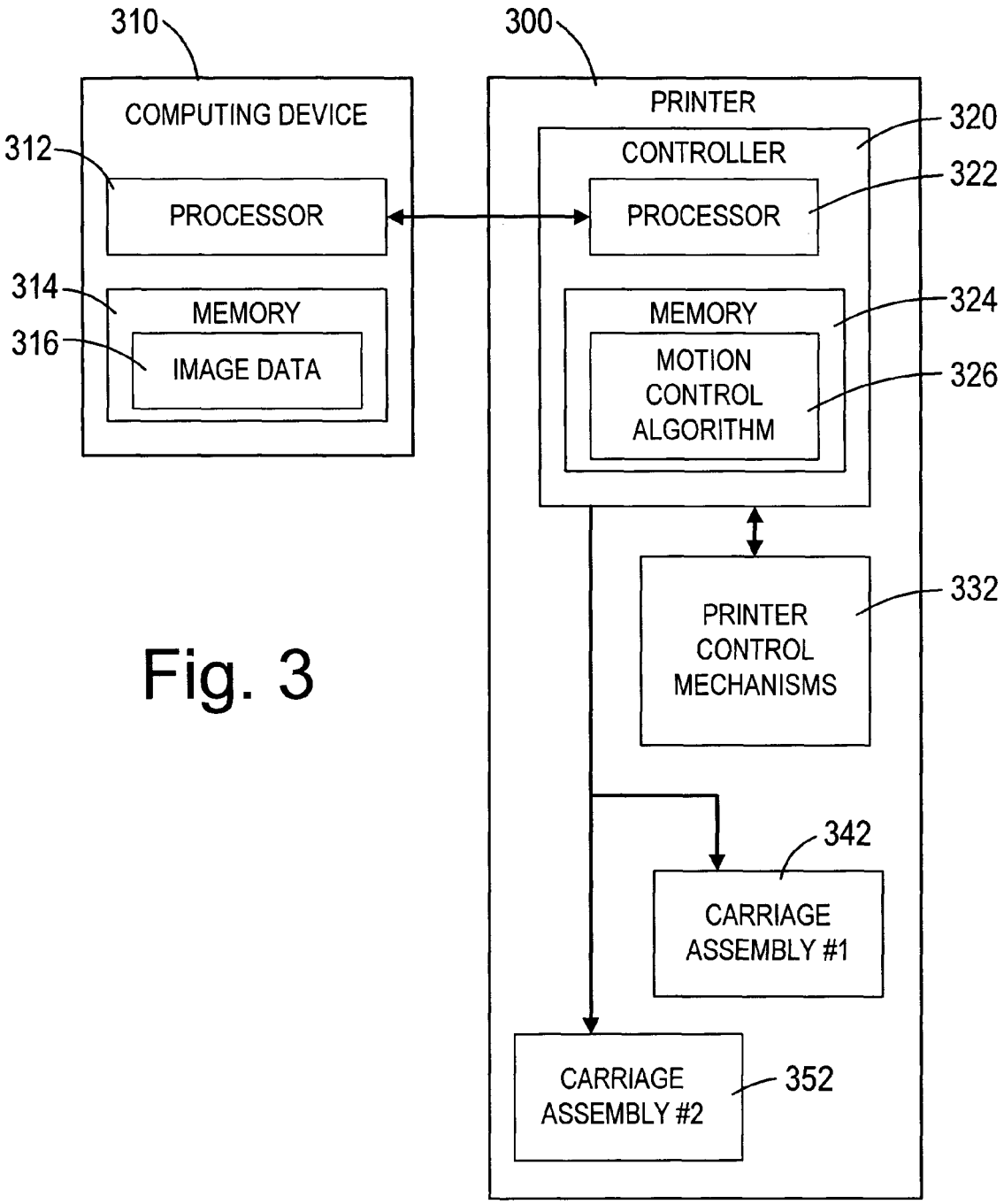
FIG. 3 is a schematic view illustrating how encoder strips are utilized in the exemplary inkjet printing system of FIGS. 1 and 2 to accurately position multiple print carriages.

FIG. 3 is a schematic view of the exemplary inkjet printing system of FIGS. 1 and 2. Computing device 310 may be a computer directly connected to the printing system 300, or there may be multiple computers accessing the printing system over a network, such as a Local Area Network (LAN). Computing device 310 typically includes a processor 312 having access to memory 314 including image data 316. The computing device 310 typically formats the image data in a form which may be utilized by printing system 300.

Printing system 300 typically includes a controller 320 which includes a processor 322 having access to memory 324. The memory may include the exemplary motion control algorithms 326 of the present invention, together with other programs, parameters, and print data.

The controller 320 typically generates print data for each carriage assembly 342, 352 in the printer, and also controls other printer mechanisms 332, such as, for example, controlling the drum rotation, paper feeding mechanism, and media dryers (not shown). Although two carriage assemblies are shown in FIG. 3, a different number of assemblies may be used, as discussed above. In generating print data for each of the carriage assemblies, the controller typically forms data addressing the individual print nozzles within each assembly, enabling those nozzles required to form the desired image.

Figure 4:
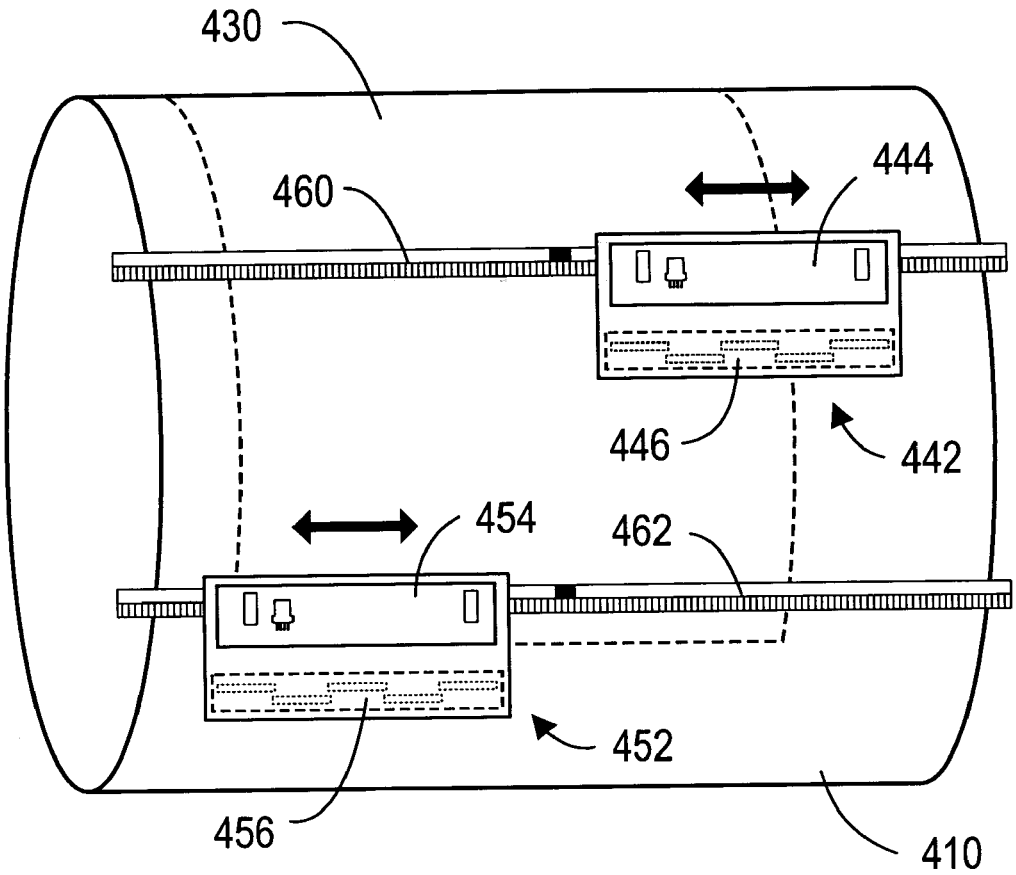
FIG. 4 further illustrates in schematic form the print carriages, encoder strips, and print drum of an exemplary inkjet printing system in which embodiments of the invention may be utilized.

FIG. 4 further illustrates in schematic form the print carriages, encoder strips, and print drum of the exemplary inkjet printing system (for clarity, mechanical components such as the support members for the carriages and the drive mechanisms for positioning the carriages are omitted from FIG. 4). As in FIG. 2, print media 430, such as paper, is held to a rotating drum 410. Positioned to span the drum parallel to the axis of rotation are encoder strips 460, 462. The encoder strips are typically formed of a substantially transparent material, such as mylar or polyester film, and have encoder markings and indexing marks for positioning the carriages, as discussed below. The print carriages 442 and 452 each include printhead arrays 446, 456 for depositing ink on the print media, and also include electronic circuitry 444, 454, which, among other functions, comprises the circuitry for sensing the carriage's position along the encoder strips.

Figure 5:
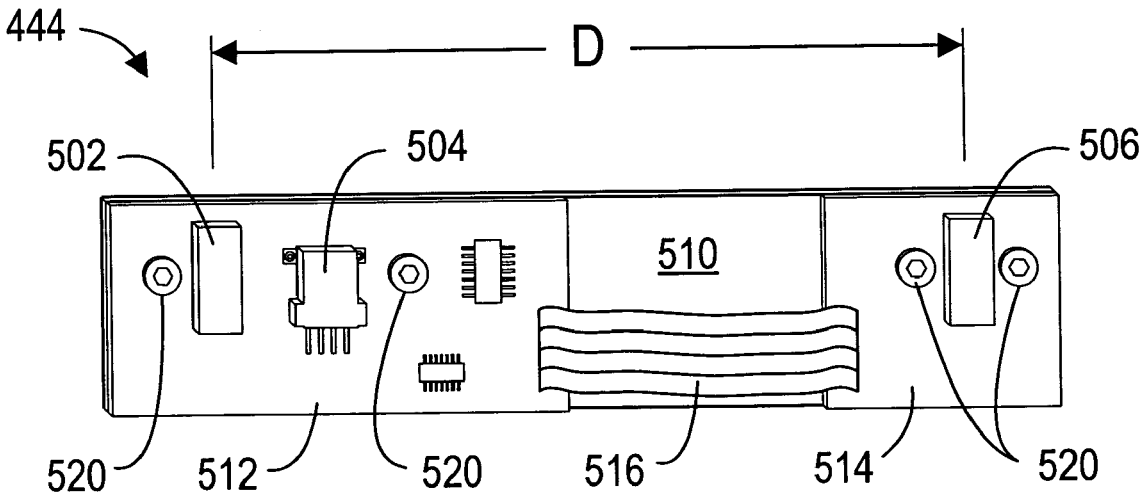
FIG. 5 illustrates the substrate, two low-cost sensors, and the analog optical encoder of an exemplary inkjet printing system utilizing an embodiment of the invention.

FIG. 5 further illustrates the carriage electronic circuitry 444 of the exemplary inkjet printing system, including an invariable substrate 510, two low-cost opto-interrupter sensors 502, 506, and the analog optical encoder 504.

The substrate 510 comprises an "invariable" material that has a very small coefficient of thermal expansion (and substantially no hydroscopic expansion), such as invar, an alloy original developed for use in mechanical clocks. Invar is available in various grades; an exemplary embodiment may use invar with a linear coefficient of thermal expansion of 1.3/° C.; as compared to an exemplary mylar encoder strip which may have a linear coefficient of thermal expansion of 17/° C. (the linear coefficient of expansion is generally expressed as the fractional change in length per degree of temperature change, typically in parts-per-million per degree centigrade). Other materials are suitable, such as liquid crystal polymer (LCP); embodiments of the invention only require that the coefficient of thermal expansion of the substrate be substantially different than the coefficient of expansion of the encoder strip.

Mounted on the substrate are two circuit boards 512, 514, which comprise the electronic circuitry. The circuit board is "split" such that any expansion or contraction of the circuit board material itself does not adversely affect the results of the methods of the invention, as described below. The two circuit boards are then electrically coupled by a jumper 516. On circuit board 512 are the analog optical encoder 504, which detects the encoder markings on the encoder strip; a first opto-interrupter 502; and various other electronic circuitry. To insure that the first opto-interrupter is fixed in relationship to the substrate, multiple fasteners 520 bracket the opto-interrupter and fasten the circuit board 512 to the substrate.

It may be noted that a conventional carriage positioning system without embodiments of the present invention would generally include the analog optical encoder 504 and an opto-interrupter 502 to sense the encoder marks and index marks on the encoder strip. Thus, the additional components needed for embodiments of the invention are the substrate 510 and the second opto-interrupter 506. Like the first opto-interrupter 502, the second opto-interrupter 506 is bracketed by fasteners 520 which firmly attach it to the substrate. The substrate, then, functions to hold the two opto-interrupts an invariable distance "D" apart.

Figure 6A:
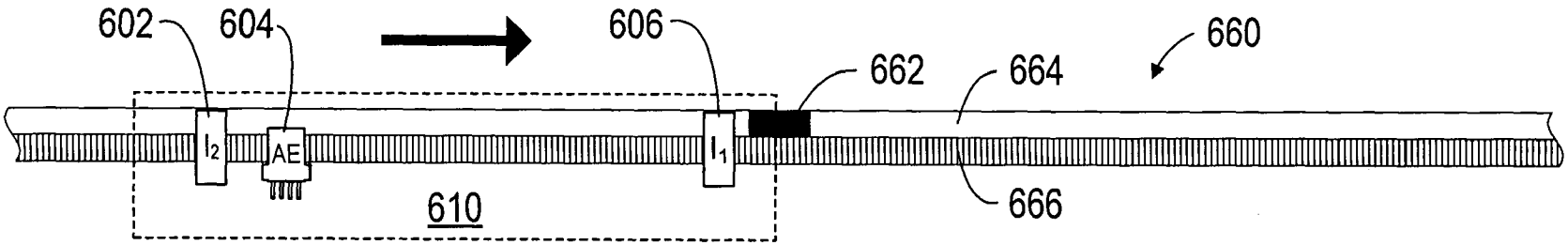
FIGS. 6(*a*) and 6(*b*) schematically illustrate an exemplary apparatus and method of the invention, showing how the sensors are moved along the encoder strip according to an embodiment of the invention.
Figure 6B:
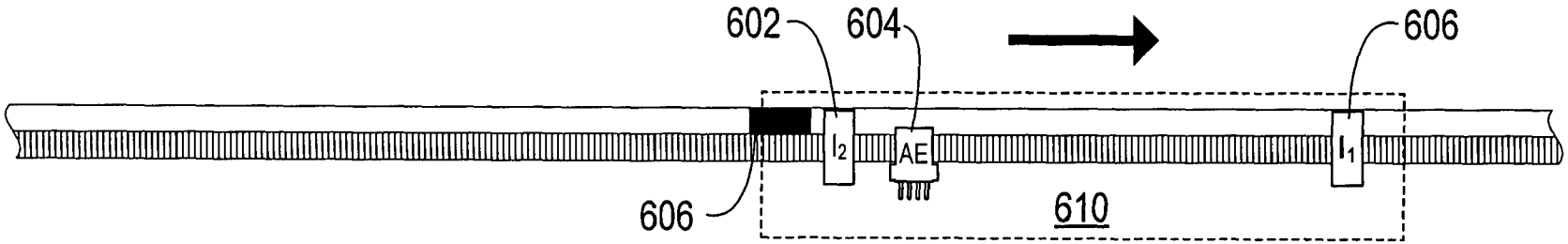

FIGS. 6(*a*) and 6(*b*) schematically illustrate an exemplary apparatus and method of the invention, showing how the various sensors are moved along the encoder strip according to an embodiment of the invention. The encoder strip 660 has first portion 664 that is clear except for one or more index marks (which are used to define one or more fixed points that carriage position may be determined in relation to), and a second portion 666 that contains encoder marks (typically at a fixed pitch, such as 200 lines per inch). As shown in FIGS. 6(*a*) and 6(*b*), the carriage is moved along the encoder strip 660 such that the two opto-interrupters 602, 606 mounted on the invariable substrate 610 sequentially pass an index mark 662 on the encoder strip. The analog optical encoder is used to essentially "count" the encoder marks that pass it between the time that the first opto-interrupter 606 and the second opto-interrupter 602 encounter the index mark (in an exemplary embodiment, with the encoder marks on the encoder strip spaced at 200 lines per inch, the analog nature of the encoder allows it to resolve the marks to a resolution of approximately 1/200,000 of an inch).

In an exemplary printing system, the procedure depicted in FIGS. 6(*a*) and 6(*b*) is initially performed immediate after (or, as part of) Automatic Pen Alignment to establish a baseline, or "nominal", count. The procedure is then repeated periodically as temperature and humidity changes affected the encoder strip, and the "measured" count obtained is compared to the "nominal" baseline count to determine a correction factor, as described below. The intervals between procedures is empirically set such that the accumulated effects of temperature and humidity changes do not adversely affect print quality. The procedure may be performed in conjunction with other printing operations, such as the periodic automatic servicing of the printheads.

Figure 7:
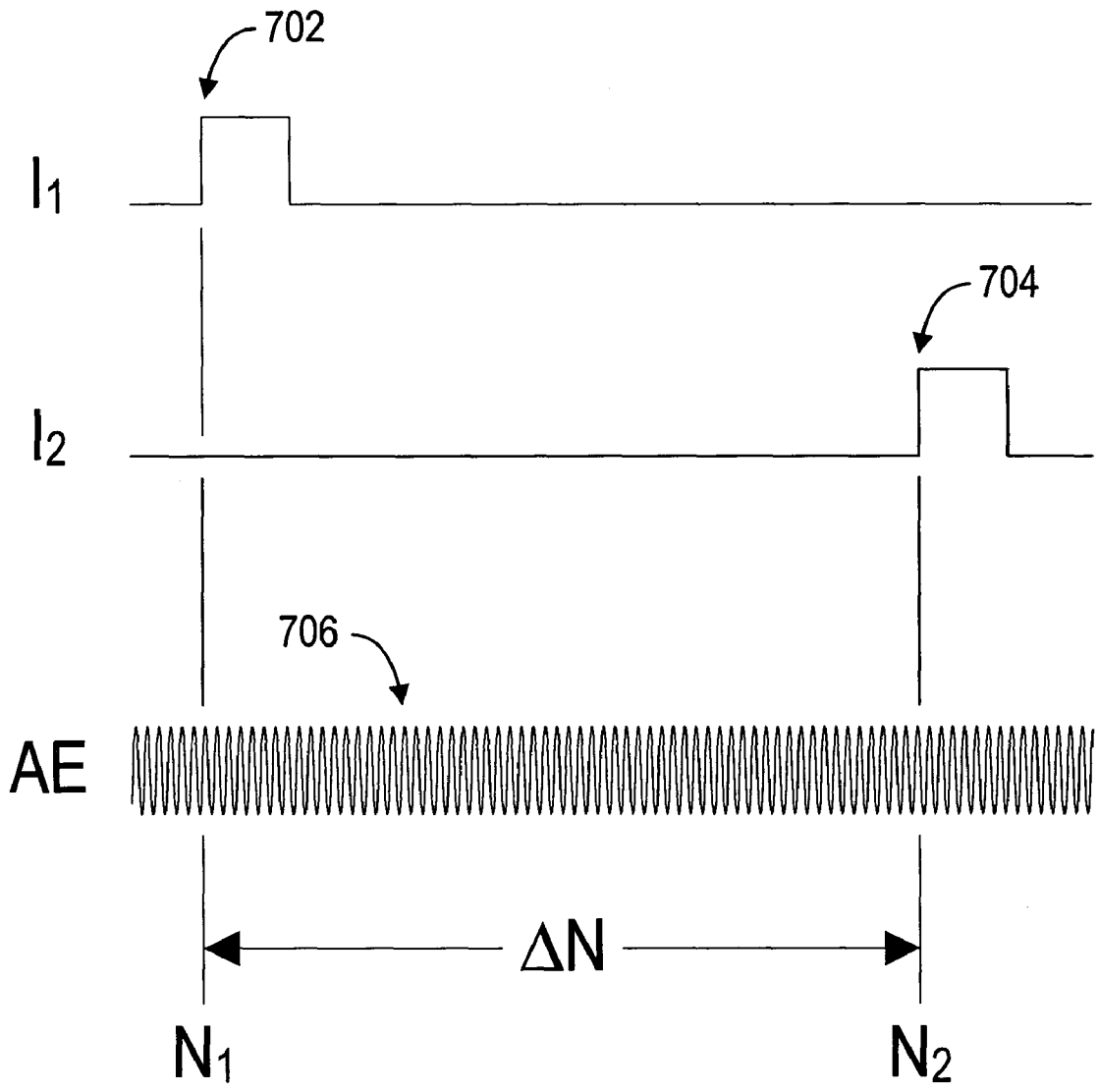
FIG. 7 is an exemplary timing diagram further illustrating an embodiment of the invention.

FIG. 7 is an exemplary timing diagram further illustrating an embodiment of the invention. When the first opto-interrupter $I_1$ passes the index mark (702), the encoder value $N_1$ is noted (the analog encoder output AE is shown at 706; the diagram is illustrative only, and is not to scale). When the second opto-interrupter $I_2$ passes the index mark (704), encoder value $N_2$ is noted. The difference between $N_2$ and $N_1$, "ΔN", is then a measure of the number of encoder marks between the two opto-interrupters, with the invariable substrate serving as a relatively fixed reference. Sensing of the opto-interrupters may be simply implemented, such as by detecting an edge transition with a General Purpose Input/Output (GPIO) port of a processor. Referring to FIG. 5, the exemplary procedure essentially determines the number of encoder marks occurring in distance "D", which will change as the encoder strip expands or contracts. As discussed below, the procedure also allows "second order" errors due to the small expansions and contractions of the substrate itself to be corrected.

After each periodic performance of the exemplary procedure the newly-determined measured difference ΔN is compared to the nominal value obtained during or immediately after Automatic Pen Alignment. The ratio of the two values allows positioning commands to the carriage to be corrected such that the expansion or contraction of the encoder strip does not affect the true position.

In mathematical terms, where

"$n_{nom}$" is the "nominal" ΔN value (obtained at APA);

"$n_{meas}$" is the most recent "measured" ΔN value, with the effects of temperature and humidity changes;

"$n_{des}$" is the "desired" carriage position; and

"$n_{cmd}$" is the corrected position to which the carriage must be commanded to achieve the desired position, then:

$$n_{cmd} = \frac{n_{des}}{n_{nom}} \times (n_{nom} - n_{meas}) + n_{des} \qquad \text{eq. 1}$$

While the above-described embodiments provide a cost-effective motion control system that compensates for thermal and hydroscopic effects on the encoder strip, a further improvement can be achieved by compensating for the temperature effects on the "invariable" substrate itself. Materials such as invar are available in different grades; the cost is generally greater for grades with smaller coefficients of thermal expansion. Thus, a less expensive grade may be utilized, and the "second order" thermal effects due to expansion or contraction of the substrate may be corrected mathematically.

Where:

"$Cte_m$" is the linear coefficient of thermal expansion of the encoder strip material;

"$Cte_i$" is the linear coefficient of thermal expansion of the substrate material;

"$n_{nom}$" is the "nominal" ΔN value (obtained at APA);

"$n_{meas}$" is the most recent "measured" ΔN value, with the effects of temperature and humidity changes;

"$n_{des}$" is the "desired" carriage position; and

"$n_{cmd}$" is the corrected position to which the carriage must be commanded to achieve the desired position, then:

$$n_{cmd} = \left( \frac{\frac{Cte_m}{Cte_i}}{\frac{Cte_m}{Cte_i} - 1} \right) \times \frac{n_{des}}{n_{nom}} \times (n_{nom} - n_{meas}) + n_{des} \qquad \text{eq. 2}$$

Utilizing the second order correction of equation 2, the substrate may be made of a lesser-grade material, so long as the coefficient of thermal expansion of the substrate material is different than that of the encoder strip. The second order correction assumes that all the expansion or contraction of the encoder strip is due to a change in temperature, rather than hydroscopic effects, however; and therefore a more invariable substrate material will generally provide better results.

Figure 8:
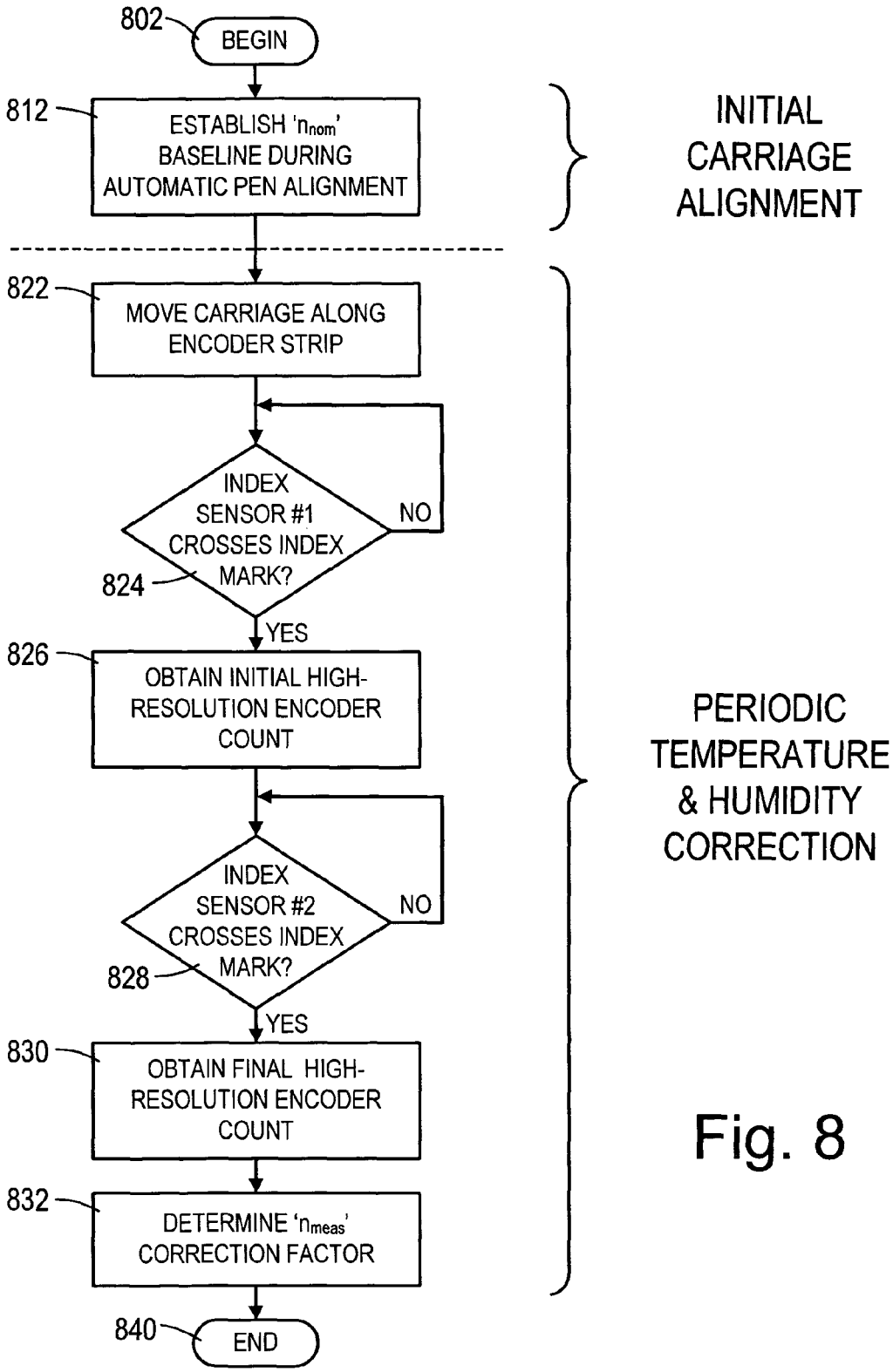
FIG. 8 is a flow chart further illustrating an embodiment of the present invention.

FIG. 8 is a flowchart further summarizing the steps of an embodiment of the present invention. The method begins 802 by establishing a baseline, $n_{nom}$, during or immediately subsequent to Automatic Pen Alignment. When correction for temperature or humidity effects is desired, the carriage is moved along the encoder strip 822 until the first index mark sensor detects 824 the index mark. An initial high-resolution encoder count is obtained 826. When the second index mark sensor detects 828 the index mark, a final high-resolution encoder count is obtained 830. The initial encoder count is then subtracted from the final encoder count to provide a correction factor "$n_{meas}$" and the method of the exemplary embodiment ends.

The above is a detailed description of particular embodiments of the invention. It is recognized that departures from the disclosed embodiments may be within the scope of this invention and that obvious modifications will occur to a person skilled in the art. It is the intent of the applicant that the invention include alternative implementations known in the art that perform the same functions as those disclosed. This specification should not be construed to unduly narrow the full scope of protection to which the invention is entitled.

The corresponding structures, materials, acts, and equivalents of all means or step plus function elements in the claims below are intended to include any structure, material, or acts for performing the functions in combination with other claimed elements as specifically claimed.

What is claimed is:

1. A motion control system, comprising:

a movable component;

an optical encoder for detecting a position along an encoder strip based on plural encoder markings, wherein the encoder strip is formed of a second material and the optical encoder is fixedly attached to the movable component; and a first sensor and a second sensor for detecting an index mark on the encoder strip, wherein the index mark is different from the encoder markings and the first sensor and second sensor are spaced apart a fixed distance and mounted to a substrate formed of a first material having substantially no hydroscopic expansion and a linear coefficient of thermal expansion of at least ten times less than a thermal coefficient of expansion of the second material, the substrate fixedly attached to the movable component;

wherein the encoder strip having encoder marks on a first portion and the one index mark on a second portion, the encoder strip positioned such that when the movable component is moved along the encoder strip the encoder marks may be detected by the optical encoder, and the at least one index mark is moved sequentially past the first sensor and the second sensor;

the first material and the second material having different coefficients of thermal expansion.

2. The motion control system of claim 1, wherein the first sensor and second sensor for detecting an index mark on an encoder strip each comprise an opto-interrupter.

3. The motion control system of claim 1, wherein the first material comprises an invariable material.

4. The motion control system of claim 3, wherein the invariable material is invar.

5. The motion control system of claim 1, wherein the second material comprises mylar.

6. The motion control system of claim 1, wherein the encoder strip has a length and is divided along the length into a first lengthwise portion and a second lengthwise portion, and wherein the encoder marks are on the first lengthwise portion and the at least one index mark is on the second lengthwise portion.

7. The motion control system of claim 1, further comprising a processor electrically coupled to the optical encoder and the first sensor and second sensor for detecting an index mark on an encoder strip.

8. The motion control system of claim 7, wherein the processor further comprises a General Purpose Input/Output (GPIO) portion, and wherein the two sensors for detecting an index mark on an encoder strip are electrically coupled to the GPIO portion.

9. The motion control system of claim 7, further comprising electronic memory with program instructions for:

determining a first encoder value substantially at a time that the first sensor detects the at least one index mark;

determining a second encoder value substantially at a time that the second sensor detects the at least one index mark; and calculating a correction factor based on the first and second encoder values.

10. The motion control system of claim 9, wherein the program instructions further comprise instructions for adjusting the correction factor for thermal expansion or contraction of the substrate formed of a first material.

11. The motion control system of claim 1, wherein the moveable component is a print carriage.

12. A motion control system, comprising: a movable component;

an optical encoder for detecting a position along an encoder strip based on encoder markings, wherein the encoder strip is formed of a second material and the optical encoder fixedly attached to the movable component;

a first opto-interrupter and a second opto-interrupter for detecting an index mark on the encoder strip, wherein the index mark is different from the encoder markings and the first opto-interrupter and the second opto-interrupter are spaced apart a fixed distance and mounted to a substrate formed of an invariable material having substantially no hydroscopic expansion and a linear coefficient of thermal expansion of at least ten times less than a thermal coefficient of expansion of the second material, the substrate fixedly attached to the movable component;

wherein the encoder strip having encoder marks on a first portion and the one index mark on a second portion, the encoder strip positioned such that when the movable component is moved along the encoder strip the encoder marks may be detected by the optical encoder, and the at least one index mark is moved sequentially past the first opto-interrupter and the second opto-interrupter; and a processor electrically coupled to the optical encoder, the first opto-interrupter, and the second opto-interrupter, the processor operable to compute a correction factor to compensate for thermal or hydroscopic changes of the encoder strip.

13. A carriage-control mechanism for a printing system, comprising: a printer carriage;

an optical encoder for detecting a position along an encoder strip based on encoder markings, wherein the encoder strip is formed of a second material and the optical encoder fixedly attached to the printer carriage;

a first sensor and a second sensor for detecting an index mark on the encoder strip, wherein the index mark is different from the encoder markings and the first sensor and second sensor are spaced apart a fixed distance and mounted to a substrate formed of a first material having substantially no hydroscopic expansion and a linear coefficient of thermal expansion of at least ten times less than a thermal coefficient of expansion of the second material, the substrate fixedly attached to the printer carriage;

wherein the encoder strip having encoder marks on a first portion and one index mark on a second portion, the encoder strip positioned such that when the printer carriage is moved along the encoder strip the encoder marks may be detected by the optical encoder, and the one index mark is moved sequentially past the first sensor and the second sensor;

the first material and the second material having different coefficients of thermal expansion.

14. The motion control system of claim 13, wherein the first sensor and second sensor for detecting an index mark on an encoder strip each comprise an opto-interrupter.

15. The motion control system of claim 13, wherein the first material comprises an invariable material.

16. The motion control system of claim 15, wherein the invariable material is invar.

17. The motion control system of claim 13, wherein the second material comprises mylar.

18. The motion control system of claim 13, wherein the encoder strip has a length and is divided along the length into a first lengthwise portion and a second lengthwise portion, and wherein the encoder marks are on the first lengthwise portion and the at least one index mark is on the second lengthwise portion.

19. The motion control system of claim 13, further comprising a processor electrically coupled to the optical encoder and the first sensor and second sensor for detecting an index mark on an encoder strip.

20. The motion control system of claim 19, wherein the processor further comprises a General Purpose Input/Output (GPIO) portion, and wherein the two sensors for detecting an index mark on an encoder strip are electrically coupled to the GPIO portion.

21. The motion control system of claim 19, further comprising electronic memory with program instructions for: determining a first encoder value substantially at a time that the first sensor detects the at least one index mark;

determining a second encoder value substantially at a time that the second sensor detects the at least one index mark; and calculating a correction factor based the first and second encoder values.

22. The motion control system of claim 21, wherein the program instructions further comprise instructions for adjusting the correction factor for thermal expansion or contraction of the substrate formed of a first material.

23. A method of compensating for environmental changes affecting an encoder strip in a motion control system, the motion control system having an encoder, the encoder strip formed of a first material and having at one index mark and plural encoder markings, the method comprising:

moving the encoder along the encoder strip;

together with the encoder, moving an encoder marking detector and a first index mark detector and a second index mark detector along the encoder strip sequentially past the encoder markings and the one index mark, respectively, the first index mark detector and second index mark detector mounted a fixed distance apart on a substrate formed of a second material having substantially no hydroscopic expansion and a linear coefficient of thermal expansion of at least ten times less than a thermal coefficient of expansion of the encoder strip, the second material having a lower susceptibility to environmental changes than the first material;

determining a first encoder reading when the first index mark detector detects the one index mark, and determining a second encoder reading when the second index mark detector detects the one index mark and determining an encoder marking reading when encoder marking detector detects at least one encoder marking; and determining a compensation value based on the encoder marking reading, the first encoder reading and the second encoder reading.

24. The method of compensating for environmental changes affecting an encoder strip in a motion control system of claim 23, wherein determining a compensation value based on the first encoder reading and the second encoder reading further comprises compensating for environmental changes of the second material.

25. The method of compensating for environmental changes affecting an encoder strip in a motion control system of claim 23, wherein the second material is invar.

* * * * *

UNITED STATES PATENT AND TRADEMARK OFFICE

CERTIFICATE OF CORRECTION

PATENT NO. : 8,182,065 B2
APPLICATION NO. : 11/192623
DATED : May 22, 2012
INVENTOR(S) : Jason Grosse et al.

It is certified that error appears in the above-identified patent and that said Letters Patent is hereby corrected as shown below:

In column 10, line 10, in Claim 23, after "having" delete "at".

Signed and Sealed this
Eleventh Day of December, 2012

David J. Kappos
*Director of the United States Patent and Trademark Office*